US005350976A

United States Patent [19]

Mulieri

[11] Patent Number: 5,350,976

[45] Date of Patent: Sep. 27, 1994

[54] FLUORESCENT LAMP STARTER

[75] Inventor: Norberto M. Mulieri, Buenos Aires, Argentina

[73] Assignee: Compania Kelmas S.A., Uruguay

[21] Appl. No.: 890,947

[22] Filed: May 29, 1992

[30] Foreign Application Priority Data

May 31, 1991 [AR] Argentina ..... 319828

[51] Int. Cl.[5] ..... H05B 41/14

[52] U.S. Cl. ..... 315/290; 315/289

[58] Field of Search ..... 315/209 R, 289, 290

[56] References Cited

U.S. PATENT DOCUMENTS

| | | | |
|---|---|---|---|
| Re. 31,486 | 1/1984 | Helmuth | 315/205 |
| 3,235,769 | 2/1966 | Wattenbach | 315/289 X |
| 3,457,458 | 7/1969 | Paget et al. | 315/284 |
| 3,466,500 | 9/1969 | Peek | 315/100 |
| 3,622,838 | 11/1971 | Michalski | 315/241 |
| 3,679,936 | 7/1972 | Moerkens | 315/205 |
| 3,705,329 | 12/1972 | Vogeli | 315/103 |
| 3,758,818 | 9/1973 | Kaneda | 315/207 |
| 3,956,665 | 5/1976 | Westphal | 315/95 |
| 4,053,811 | 10/1977 | Abernethy | 315/95 |
| 4,107,581 | 8/1978 | Abernethy | 315/324 |
| 4,179,641 | 12/1979 | Britton | 315/289 |
| 4,876,486 | 10/1989 | Joanino | 315/290 |
| 4,885,507 | 12/1989 | Ham | 315/244 |
| 5,023,521 | 6/1991 | Sridharan | 315/290 |
| 5,047,694 | 9/1991 | Nuckolls et al. | 315/290 |
| 5,049,789 | 9/1991 | Kumar et al. | 315/289 |
| 5,059,870 | 10/1991 | Choon | 315/289 |

*Primary Examiner*—Tony M. Argenbright
*Attorney, Agent, or Firm*—D. Peter Hochberg; Mark Kusner; Michael Jaffe

[57] ABSTRACT

An electronic starter for fluorescent lamps includes a hybrid solid state switch energized by a line and filtering unit connected in series with a pulse restrictor. The inputs of the hybrid solid state switch and the line and filtering unit are connected to a terminal. Also included in the starter is a pulse generator connected to the output of the hybrid solid state switch, the output of the pulse generator being connected to another terminal. The starter is connectable through such terminals to a power source, is parallel to the bridged terminals of a fluorescent lamp, and in series to the ballast of the lamp.

9 Claims, 1 Drawing Sheet

FLUORESCENT LAMP STARTER

TECHNICAL FIELD

The present invention pertains to an electronic starter for fluorescent lights. It specifically relates to a solid state circuit which when used as a replacement for conventional starters results in optimal ionization of the gas inside fluorescent lights.

BACKGROUND OF THE INVENTION

There are presently several known types of fluorescent light starters which can be divided into four main groups:

1) mechanical filament heating;
2) electronic filament heating;
3) high voltage induction (thermal rapid-start); and
4) electronic ballasts (frequency generators).

The conventional starters are found in Group 1. These contain a noble gas, at a low pressure that surrounds a pair of electrodes. One of these electrodes is formed by two bimetallic strips with different coefficients of thermal expansion. The starters are connected to the four terminals of the fluorescent light, and cause the triggering through the generation of a high voltage, the same that produces the discharge in the interior of the fluorescent tube. Although these are simple and very inexpensive, they have a number of disadvantages: their useful life is shorter than the fluorescent light's life. They are incapable of adjusting to the variation in the supply voltage. They have a slow operating cycle, of between 2 and 4 seconds which produces overheating of the tube's terminals, thus shortening the tube's useful life and producing a darkening of the ends of the tube.

Group 2 contains a variety of devices that use solid state components to replace the conventional starters. Some of them consist of an active semi-conductor device, for instance, a high-voltage transistor that acts as a switch. However, they have the annoying side effect of generating radio-frequency interference in radios and televisions near the tube. Still others use Triac thyristors as switches but they have problems triggering the fluorescent tube under low temperature conditions.

Argentine Patent No. 216,722 represents an attempt to solve the above-mentioned short-comings, by adding a capacitor to the switching element. Although this arrangement results in the triggering of the tube, due to the size of the capacitor, the triggering produces premature wear of the filaments of the fluorescent light. Consequently, the heating stage stops working, resulting in the loss of continuity.

Group 3 contains the high voltage inductive starters that are marketed as "Rapid-Start" or R.S. devices. These starters which have a special transformer and reactance coil are mounted on top of a module and pre-wired to the lighting device. They also have a capacitive strip for auxiliary external starting connected to ground.

As with all the previous devices, the "Rapid-Start" starters are connected to the four terminals of the fluorescent tube. They have the inherent disadvantage of an appreciably higher cost, and the elements that form part of such devices have a significantly larger size than other starting devices.

Group 4 contains high frequency emitter electronic ballasts without starting stages, that replace or eliminate the inductive reactance ballasts. Although these devices work satisfactorily, conventional installations need to be replaced prior to its installation. Consequently, such devices are more expensive than the other starters. Not only are they more expensive, but if they fail, their repair is relatively complicated. They also produce serious radio-frequency interference in radios and computers.

Argentine Patent 235,285 discloses an electronic starting system for fluorescent tubes. The system is based on a solid state switch that contains a thyristor which also provides a heating current to the terminals and an active capacitive branch that generates a series of high voltage pulses between the tube's electrodes. It is a disadvantage of the system, however, that it does not start with low voltage current, and that it oscillates with dimmer systems. Its functioning is also based on the continuity of the tube's filaments. As with all of the other devices describes, this starter circuit is connected to the four terminals of the fluorescent light.

BRIEF DESCRIPTION OF THE INVENTION

In view of the foregoing, therefore, an objective of the present invention is to obtain the starting and triggering of fluorescent lights with conventional ballasts, even under adverse low voltage conditions, or in cases where there is an interruption of the tube's filaments.

It is also an objective of this invention, to obtain a stable continuity of triggering despite the presence of voltage drops in the power supply, or in the line.

It is another objective of the present invention to obtain a substantial reduction in installation costs as a consequence of the fact that the connection of the starter, ballast and line are accomplished through a single terminal on each end of the tube. Thus less wiring is needed to connect the various devices that form part of the fluorescent light.

The fact that the tube is connected through a single terminal at each of its ends means that the starting of the tube is done with "cold tips", i.e., without any heating of the filaments; this saves energy during the starting stage. Such savings are particularly important in places where many tubes are in use.

The useful life of the tube filament is also extended.

Another objective of this invention is to provide triggering of the fluorescent tubes without producing radio-frequency interference in radios, televisions or computers near the point of installation of the fluorescent tubes.

The preceding and additional objectives of this invention are provided by the design of an electronic starter for fluorescent lights of the type which is connected in parallel with the fluorescent tube, and in series with the ballast. The starter is characterized in consisting of a hybrid solid state switch energized by a line and filtering detector unit, and by a pulse restrictor connected in series. The inputs of the hybrid switch, and the line and filtering detector unit are connected to one terminal. The output of the hybrid switch is connected to a pulse generator, while the output of the pulse generator is connected to a second terminal. These terminals are connected to the line, ballast and bridged terminals of the fluorescent tube, one on each end of the fluorescent tube.

BRIEF DESCRIPTION OF THE DRAWINGS

The invention will be better understood when reference is had to the drawings showing a preferred embodiment but not a limiting one of the invention, in which.

DETAILED DESCRIPTION OF THE INVENTION

Figure 1:
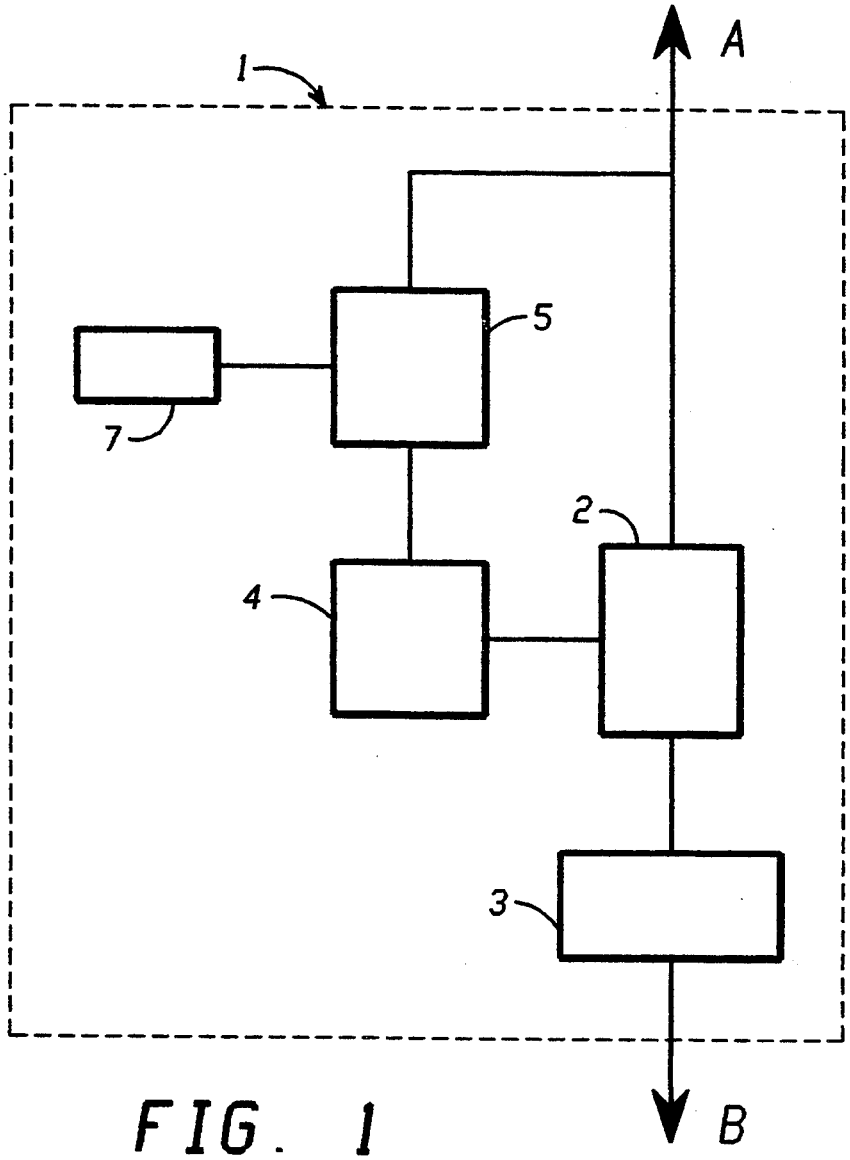
FIG. 1 shows a block diagram of the electronic starter device of the invention.

The electronic starter device of this invention contains a solid state hybrid switch (2). This switch includes a Triac-type stage and is connected to a pulse generator (3) that sends pulses which make possible the starting and triggering of the fluorescent light even under low-voltage conditions, for example, 150 V. This pulse generator (3) is controlled by the solid state hybrid switch (2). At the same time, the solid state hybrid switch (2) is controlled by a pulse restrictor (4), which in turn is activated by a line and filtering detector unit (5).

The electronic starter functions almost to the limit of the voltage transfer produced by the ballast (6), as a reactive effect. The function is performed by the line and filtering detector unit (5). This filtering stage performs protective functions by releasing the electronic starter (1) when the reactive effect occurs. During its active stage it remains connected to the line when a stand-by condition arises in the supply line.

In addition, the electronic starter (1) has an indicator light (7). This indicator shows the presence of voltage on the supply line and confirms that the installation has been properly performed. It also dampens the voltage spikes that would otherwise act on the input gate at the hybrid switch (2) and the pulse restrictor (4).

Figure 2:
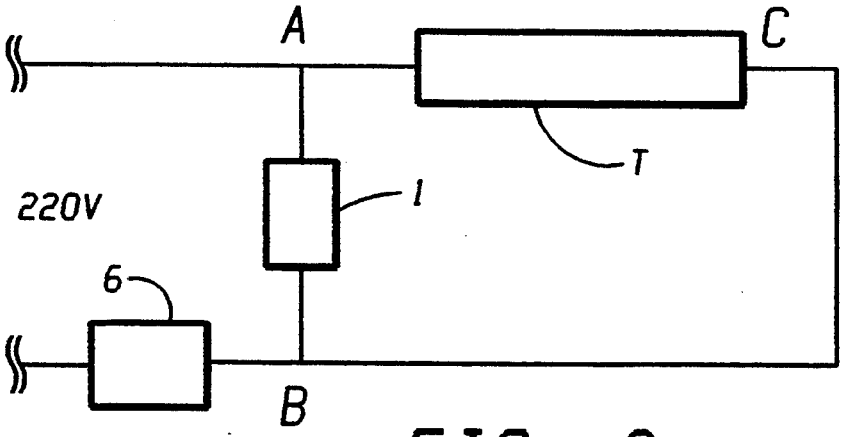
FIG. 2 shows the circuit diagram of the electronic starter device of the invention.

As shown in FIG. 2, the electronic starter device of this invention (1) is connected in parallel, to the bridged terminals of the fluorescent tube (T), and in series with the ballast (6) using a single-strand wire.

It is important to note that the invention allows the starting and triggering of fluorescent lights with a single terminal at each end of the tube. This makes the traditional socket installation unnecessary, thus obtaining significant savings, for instance, 50% on the wiring.

Savings in energy consumption are also achieved during the starting operation, because heating does not occur in the filaments of the fluorescent tube. This represents a considerable saving in places where there are a large number of tubes are installed. Furthermore, because of this feature, overheating of the device does not occur during starting.

The ideal operating conditions for the electronic starter device of this invention, are within the general conditions of 220 V±5 V, 50 Hz and temperatures between −5° C. and 40° C. However, it has been shown that even if these conditions are modified, the triggering of the tubes still takes place and can even constitute an improvement on the functioning levels of tubes with conventional starters. The following results have been obtained by testing 40 watts fluorescent tubes:

| | Disclosed Starter Optimal conditions: 220 volts, 50 Hz, 25° C. | Electronic Starter Low voltage, high temperature, 200 volts, 50 Hz, 40° C. | Conventional Starter Optimal conditions: 200 volts, 50 Hz, 25° C. |
|---|---|---|---|
| Luminosity | 112 | 87 | 100 |
| Starting Delay | 0.2 seconds | 0.5 seconds | 3 seconds |
| % Power Consumption in triggering | 40 | 70 | 100 |
| Detection of line noise level | 0.2 | 0.5 | 1.5 |

It has been observed that the filtering element eliminates these noise signals and the harmonics emitted by the ballast, and that contaminate the power source.

Several tests have been done, showing that with the electronic starter disclosed herein, it is possible to start the fluorescent tube with voltages as low as about 152 volts.

Duration tests have also been performed which show that the starter is able to withstand without any problems more than 200,000 triggering actions with a maximum frequency of about 350 triggerings per minute.

In a preferred embodiment of this invention, the electronic starter is mounted on top of a printed circuit. The A and B terminals of the starter are compatible with conventional sockets.

The pulse generator (3) contains a bi-directional module of the Triac-type, i.e., 80 v, 6 A-12 A, connected in series to a group of capacitors, whose values lie within the range of 0.6 μF to 3 μF, according to the usage requirements. It has an insulation of 650 volts to withstand the spikes and harmonics to which it is subjected at the moment of triggering. The Triac bi-directional module is controlled through its own gate by the pulse restrictor (4), to which it is connected by means of a Diac element with a rating of 30 V and 200 Ma.

The pulse restrictor (4) is formed by an arrangement of resistances and capacitors, matched and connected to the line and filtering detector unit (5).

The line detector stage is formed by a voltage divider made of resistances that feed the indicator light. It also links the pulse restrictor (4) and the pulse generator (3), to the line, or to the ballast (6).

The filtering stage of the line and filtering detector (5) is of the R-C type (resistive-capacitive). It is connected in series and suitably tuned, with capacitance values between 0.045 μF (400 V), and with resistance values between 33 ohms and 100 ohms. Its purpose is to protect the network and the ballast from the harmonics and the resonances generated during the triggering of the fluorescent tubes.

The light indicator (7) consists of a neon bulb.

While in accordance with the patent statutes, a preferred embodiment and best mode has been presented, the scope of the invention is not limited thereto, but rather is measured by the scope of the attached claims.

What is claimed is:

1. A fluorescent lighting system including:

an electronic starter comprising (a) a hybrid solid state switch energized by a line and filtering detector unit connected in series with a pulse restrictor, the inputs of said hybrid solid state switch and said line and filtering detector unit being connected to a first terminal, and (b) a pulse generator connected to the output of said hybrid solid state switch, the output of said pulse generator being connected to a second terminal;

a fluorescent light tube having bridged terminals, and a ballast, wherein said electronic starter is connectable through said first and second terminals to a power source, and connected in parallel to said bridged terminals and in series to said ballast.

2. A system according to claim 1 which further comprises an indicator light connected to said line and filtering detector unit.

3. A fluorescent lighting system according to claim 1, wherein said pulse generator is formed by a Triac-type, bi-directional module connected in series to a plurality of capacitors able to withstand the imposition of 650 volts thereon, wherein said line and filtering detector unit is provided by a line detection stage comprising a voltage divider including resistors having indiscriminate polarity connected in series with a filtering stage of the resistive-capacitive type, and wherein the output of said line and filtering detector unit is connected through a Diac to the gate of said Triac-type, bi-directional module.

4. A fluorescent lighting system according to claim 1 wherein said electronic starter is connected to said power source, ballast and fluorescent light tube through two, single-strand wires.

5. An electronic starter comprising:

a hybrid solid state switch energized by a line and filtering detector unit connected in series with a pulse restrictor, the inputs of said hybrid solid state switch and said line and filtering detector unit being connected to a first terminal, and a pulse generator connected to the output of said hybrid solid state switch, the output of said pulse generator being connected to a second terminal.

6. An electronic starter according to claim 5 which further comprises an indicator light connected to said line and filtering detector unit.

7. An electronic starter according to claim 5 having connecting terminals compatible with conventional terminal-receiving sockets.

8. An electronic starter according to claim 5 wherein said pulse generator is formed by a Triac-type, bi-directional module connected in series to a plurality of capacitors able to withstand the imposition of 650 volts thereon.

9. An electronic starter according to claim 8 wherein said line and filtering detector unit is provided by a line detection stage comprising a voltage divider including resistors having indiscriminate polarity connected in series with a filtering stage of the resistive-capacitive type, and wherein the output of said line and filtering detector unit is connected through a Diac to the gate of said Triac-type, bi-directional module.

* * * * *